US009174272B2

(12) United States Patent
Kweon et al.

(10) Patent No.: US 9,174,272 B2
(45) Date of Patent: Nov. 3, 2015

(54) TWIN ROLL STRIP CASTING METHOD

(71) Applicant: POSCO, Pohang-si (KR)

(72) Inventors: Oh-Seong Kweon, Pohang-si (KR); Suk-Kyun Hwang, Pohang-si (KR); Seong-In Jeong, Pohang-si (KR)

(73) Assignee: POSCO, Pohang-Si (KR)

( * ) Notice: Subject to any disclaimer, the term of this patent is extended or adjusted under 35 U.S.C. 154(b) by 0 days.

(21) Appl. No.: 14/570,156

(22) Filed: Dec. 15, 2014

(65) Prior Publication Data

US 2015/0174650 A1 Jun. 25, 2015

(30) Foreign Application Priority Data

Dec. 20, 2013 (KR) ..... 10-2013-0160261

(51) Int. Cl.
*B22D 11/06* (2006.01)
*B22D 11/16* (2006.01)
*B22D 11/00* (2006.01)

(52) U.S. Cl.
CPC ..... *B22D 11/168* (2013.01); *B22D 11/001* (2013.01); *B22D 11/0622* (2013.01)

(58) Field of Classification Search
CPC ..... B22D 11/06; B22D 11/16
USPC ..... 164/479–483
See application file for complete search history.

(56) References Cited

U.S. PATENT DOCUMENTS

| | | | | | |
|---|---|---|---|---|---|
| 5,052,467 | A * | 10/1991 | Tanaka et al. | ..... | 164/452 |
| 6,079,480 | A * | 6/2000 | Oka et al. | ..... | 164/452 |
| 6,524,408 | B1 * | 2/2003 | Schmitz et al. | ..... | 148/541 |
| 6,820,680 | B1 * | 11/2004 | Fukase et al. | ..... | 164/483 |
| 6,915,839 | B2 * | 7/2005 | Poloni et al. | ..... | 164/483 |
| 2011/0308739 | A1 | 12/2011 | McCutcheon et al. | | |

FOREIGN PATENT DOCUMENTS

| | | | |
|---|---|---|---|
| EP | 0788854 | A1 | 8/1997 |
| KR | 10-2009-0024874 | A | 3/2009 |
| KR | 10-2011-0139072 | A | 12/2011 |
| KR | 10-2013-0075015 | A | 5/2013 |

* cited by examiner

*Primary Examiner* — Kevin E Yoon
(74) *Attorney, Agent, or Firm* — The Webb Law Firm

(57) ABSTRACT

There is provided a strip casting method using a twin roll strip casting process in which molten steel is supplied through an injection nozzle to a region between twin rolls rotating in opposite directions to produce a strip having a predetermined thickness and a high degree of edge quality. The twin roll strip casting method includes: performing the casting process by setting a casting thickness to have a minimal value during an early stage of the casting process in which edge bulging occurs; and performing the casting process by increasing the casting thickness to a maximum value after the molten steel reaches a pre-set target temperature as the casting process proceeds.

3 Claims, 5 Drawing Sheets

TWIN ROLL STRIP CASTING METHOD

CROSS-REFERENCE TO RELATED APPLICATION

This application claims the priority and benefit of Korean Patent Application No. 10-2013-0160261 filed on Dec. 20, 2013, with the Korean Intellectual Property Office, the disclosure of which is incorporated herein by reference.

BACKGROUND

The present disclosure relates to a twin roll strip casting method, and more particularly, to a twin roll strip casting method for producing strips having a high degree of edge quality.

In general, strips are produced as follows. A slab is produced from molten steel through a continuous casting process, and the slab is formed as a hot-rolled coil through a reheating and hot-rolling process. The hot-rolled coil undergoes hot band annealing and pickling in a hot annealing & pickling line, and then the hot-rolled coil is formed as a final product through a cold rolling process.

The above-mentioned continuous casting method is complex because casting and rolling processes are performed separately. In addition, since reheating slab is necessary to allow the rolling process to be performed after the casting process, a large amount of energy is consumed, and thus the continuous casting method is not favored in terms of economical and environmental aspects. In order to overcome demerits of the continuous casting method, a twin roll strip casting method in which a thin steel sheet (strip) is produced directly using twin rolls has been developed.

FIG. 1 is a schematic view illustrating a twin roll strip casting process of the related art.

In a twin roll strip casting method of the related art, as shown in FIG. 1, a pair of internal water-cooled rolls 110 are rapidly rotated in mutually engaging directions, and while molten steel 130 is supplied to a region between the rolls 110 through an injection nozzle 120, a strip 140 having a thickness of 10 mm or less is drawn out therefrom.

When strips are produced by such a twin roll strip casting method, defects such as edge bulges or edge cracks may be formed. Edge bulges make it difficult to perform a hot rolling process and cause edge cracks or shape errors during a rolling process, thereby decreasing the process yield.

If 200 mm to 300 mm wide edge regions of a strip are relatively hot, as compared to the other regions of the strip, due to an edge region solidification delay phenomenon, the thickness of the strip may be locally increased (to about 50 mm) in the edge regions, or the strip may be torn. This is a phenomenon is known as "edge bulging." The edge region solidification delay phenomenon may be considered to be a characteristic of a twin roll strip casting process. When shells undergo solidification and shrinkage, if edge regions of the shells that are relatively free, as compared to center regions of the shells, are separated from casting rolls, edge region solidification delay may occur due to a relatively poor heat transfer rate in the separated edge regions. If the edge region solidification delay occurs severely, edge bulging may occur. In this case, the edge regions may crack or molten steel may leak during a casting process. Furthermore, during a rolling process, a reduction ratio may be varied in the width of a strip as the edge regions may be relatively thick or hot. Therefore, the shape of the strip may be deformed, or due to poor rolling conditions caused by edge waves, cracks may be formed, thereby lowering the process yield.

SUMMARY OF THE INVENTION

An aspect of the present disclosure may provide a strip casting method for producing strips having a high degree of edge quality by minimizing edge bulging.

According to the strip casting method of the present disclosure, strips having a high degree of quality may be produced, and since defects are preemptively prevented, manufacturing costs, material costs, and labor costs may be saved. In addition, the efficiency of a twin roll strip casting process may be improved.

However, aspects of the present disclosure are not limited thereto. Additional aspects will be set forth in part in the description which follows, and will be apparent from the description to those of ordinary skill in the related art.

According to an aspect of the present disclosure, there is provided a strip casting method using a twin roll strip casting process in which molten steel is supplied through an injection nozzle to a region between twin rolls rotating in opposite directions to produce a strip having a predetermined thickness and a high degree of edge quality, the twin roll strip casting method may include: performing the casting process by setting a casting thickness to have a minimal value during an early stage of the casting process in which edge bulging occurs; and performing the casting process by increasing the casting thickness to a maximum value after the molten steel reaches a pre-set target temperature as the casting process proceeds.

The minimal value of the casting thickness may be set to be within a range of 130% to 150% of a final product thickness to obtain a reduction ratio of 25% or above.

The maximum value of the casting thickness may be set to be within a range of 150% to 200% of the final product thickness.

The casting thickness may be increased to reduce an amount of wear of edge dams and consequently increase a casting amount by at least 25%.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION OF THE INVENTION

Figure 1:
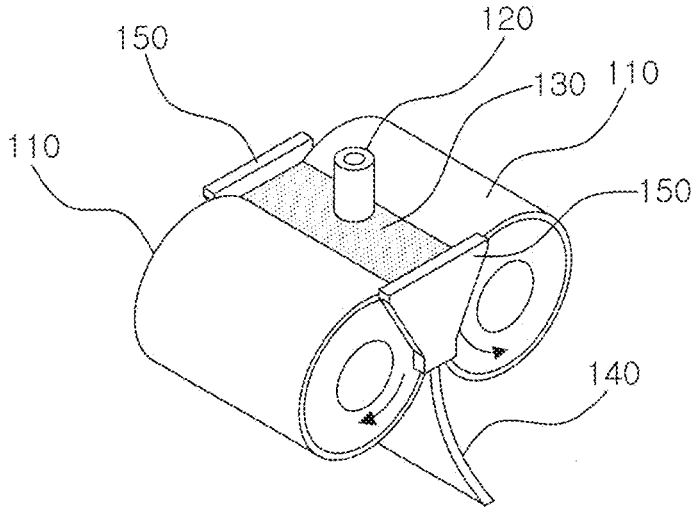
FIG. 1 PRIOR ART
FIG. 1 is a schematic view illustrating a twin roll strip casting process of the related art.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

According to an exemplary embodiment of the present disclosure, a strip casting method uses a twin roll strip casting process. That is, an exemplary embodiment of the present disclosure provides a twin roll strip casting method in which molten steel is supplied through an injection nozzle to a region between twin rolls which are rapidly rotated in opposite directions so as to produce a strip having a desired thickness. In the exemplary embodiment of the present disclosure, the composition of molten steel for producing strips is not limited. For example, austenitic stainless strips may be produced. In this case, molten steel for producing the austenitic stainless strips may include carbon (C): 0.1 wt % or less, chromium (Cr): 12 wt % to 25 wt %, nickel (Ni): 5 wt % to 12 wt %, and the balance of iron (Fe) and inevitable impurities.

In the strip casting method using a twin roll strip casting process according to the exemplary embodiment of the present disclosure, a casting thickness is adjusted to a minimal value (minimal thickness) to prevent defects such as internal pores in an early stage of the casting process in which edge bulging mainly occurs, and then the casting thickness is increased to a maximal value (maximal thickness) after the occurrence of edge bulging reduces, that is, after the temperature of molten steel reach a preset target temperature. In this way, strips having a high degree of edge quality may be produced with an increased yield compared to other casting processes producing strips having the same thickness.

If edge region solidification delay occurs, the temperature of edge regions is relatively high, and molten steel is trapped between the solidified shells. Therefore, the thickness of a strip is locally increased in edge regions of the strip. This is known as "edge bulging." Edge bulging frequently occurs in an early stage of casting due to the following reason. In an early stage of casting, the temperatures of casting rolls and edge dams are relatively low, and thus the temperatures of solidified shells and molten steel of a molten steel pool that make contact with the casting rolls and the edge dams are largely varied. As a result, non-uniform solidification occurs to increase separation and bulging of edge regions of the solidified shells. In addition, if the temperature of molten steel contained in the molten steel pool is higher than a target value, a large temperature differential is observed between internal and external portions of the solidified shells, and thus non-uniform solidification occurs to increase the separation and bulging of edge regions of a strip.

Figure 2:
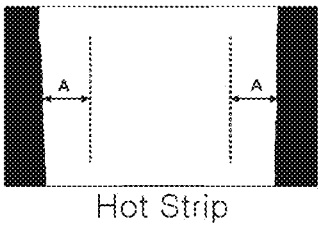
FIG. 2 PRIOR ART
FIG. 2 is an image of a hot strip disposed under a casting roll when edge bulging occurs in a twin roll strip casting process of the related art.
Figure 3:
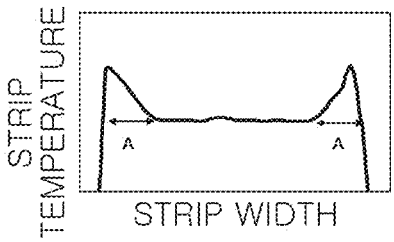
FIG. 3 PRIOR ART
FIG. 3 is a graph illustrating widthwise temperature distribution when edge bulging occurs in a twin roll strip casting process of the related art.
Figure 4:
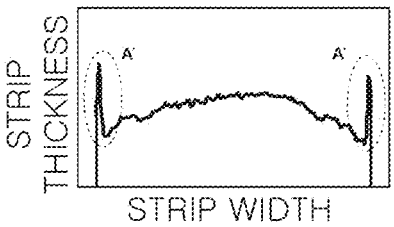
FIG. 4 PRIOR ART
FIG. 4 is a graph illustrating thickness distribution when edge bulging occurs in a twin roll strip casting process of the related art.

FIGS. 2 to 4 are an image of a hot strip disposed under a casting roll, a graph illustrating the temperature of the strip with respect to the width of the strip, and a graph illustrating the thickness of the strip with respect to the width of the strip when edge bulging occurs in a twin roll strip casting process of the related art.

In detail, FIG. 2 illustrates the surface state of a hot strip disposed under a casting roll when edge bulging occurs. Referring to FIG. 2, edge regions A of the strip are relatively bright compared to a center region of the strip because the edge regions A have relatively high temperatures. This is shown more clearly in FIG. 3 illustrating the temperature of the strip with respect to the width of the strip. FIG. 4 illustrates the thickness of the strip with respect to the width of the strip. Referring to FIG. 4, edge regions A are relatively thick.

As shown in FIG. 4, the edge regions A which are relatively thick due to edge bulging may be cracked or deformed as wave shapes in a rolling process due to different reduction ratios in the width direction of the strip. Therefore, the strip may have a defective shape, and the process yield may be decreased.

Figure 5:
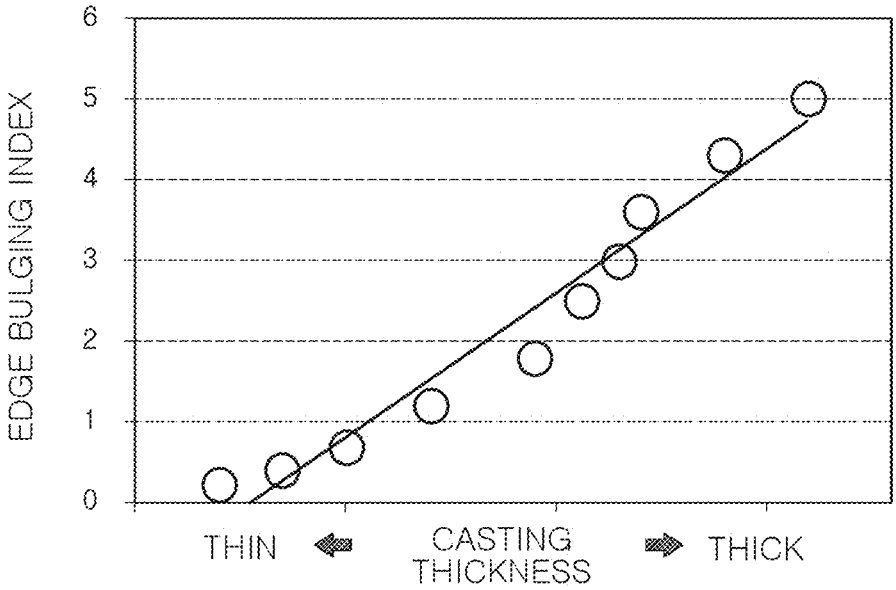
FIG. 5 PRIOR ART
FIG. 5 is a graph illustrating a relationship between an edge bulging index and a casting thickness in a twin roll strip casting process of the related art.

FIG. 5 is a graph illustrating a relationship between an edge bulging index and an initial casting thickness when 304-type austenitic stainless strips having carbon (C): 0.06 wt %, chromium (Cr): 18 wt %, nickel (Ni): 8 wt %, nitrogen (N): 0.04 wt %, and the balance of iron (Fe) and inevitable impurities are produced under the same process conditions. As shown in FIG. 5, the initial casting thickness is proportional to the edge bulging index. The reason for this is as follows. If the casting thickness increases, the rate of casting is decreased. In this case, although solidified shells make contact with casting rolls for a longer period of time, the rate of solidification is largely varied between the center and edge regions of the casting rolls, and thus the separation and bulging of edge regions of a strip are increased.

Figure 6:
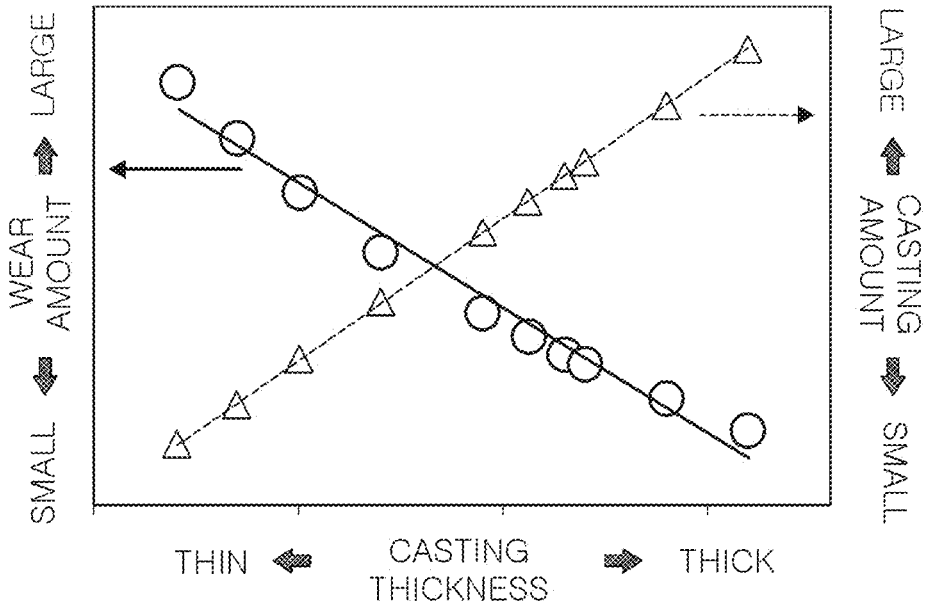
FIG. 6 PRIOR ART
FIG. 6 is a graph illustrating a wear amount and a casting amount with reference to a casting thickness in a twin roll strip casting process of the related art.

FIG. 6 is a graph illustrating the wear amount of an edge dam refractory material and the amount of casting with respect to a casting thickness. Referring to FIG. 6, when the amount of casting is fixed, if the casting thickness is decreased, the length of a strip making frictional contact with the edge dam refractory material is increased, and thus the wear amount of the edge dam refractory material is increased. Therefore, when the wear amount (thickness) of the edge dam refractory material is fixed, the amount of casting is decreased. That is, if the casting thickness is decreased to reduce edge bulging, the wear amount is increased, and thus the amount of casting is decreased.

Therefore, as a method of reducing initial edge bulging and increasing the amount of casting, the inventors have proposed a method of increasing a casting thickness according to the progress of casting.

That is, in the strip casting method using a twin roll strip casting process according to the exemplary embodiment of the present disclosure, a casting thickness is adjusted to a minimal value (minimal thickness) so as to prevent defects such as internal pores in an early stage of the casting process in which edge bulging mainly occurs, and then the casting thickness is increased to a maximal value (maximal thickness) after the occurrence of edge bulging reduces, that is, after the temperature of molten steel reach a preset target temperature. In addition, since the casting thickness is increased in the middle of the casting process, the wear amount of edge dams may be reduced, and thus the amount of casting may be increased when a strip having the same thickness is produced.

In the present disclosure, it may be preferable that the minimal thickness be set to be within the range of 130% to 150% of the thickness of a final product to satisfy a reduction ratio of 25% or above and prevent defects such as internal pores in a strip in an early stage of casting.

Furthermore, in the exemplary embodiment of the present disclosure, when the casting thickness is increased as casting proceeds, it may be preferable that the maximal thickness be set to be within the range of 150% to 200% of the thickness of the final thickness so as not to cause edge bulging.

In the exemplary embodiment of the present disclosure, the minimal value and the maximal value of a casting thickness are determined relative to the thickness of a final product within ranges not causing defects in a strip casting process. That is, when a casting material having a casting thickness (a) is rolled into a strip having a final thickness (b) using an in-line rolling mill, if a reduction ratio of is lower than 25%, the strip may have defects such as pores due to process characteristics. Therefore, to prevent such defects, the minimal thickness in an early stage of casting is set such that the reduction ratio may be 25% or above, and the maximal thickness up to which the casting thickness is increased as casting proceeds is set to be within a range not causing edge bulging.

Figure 7:
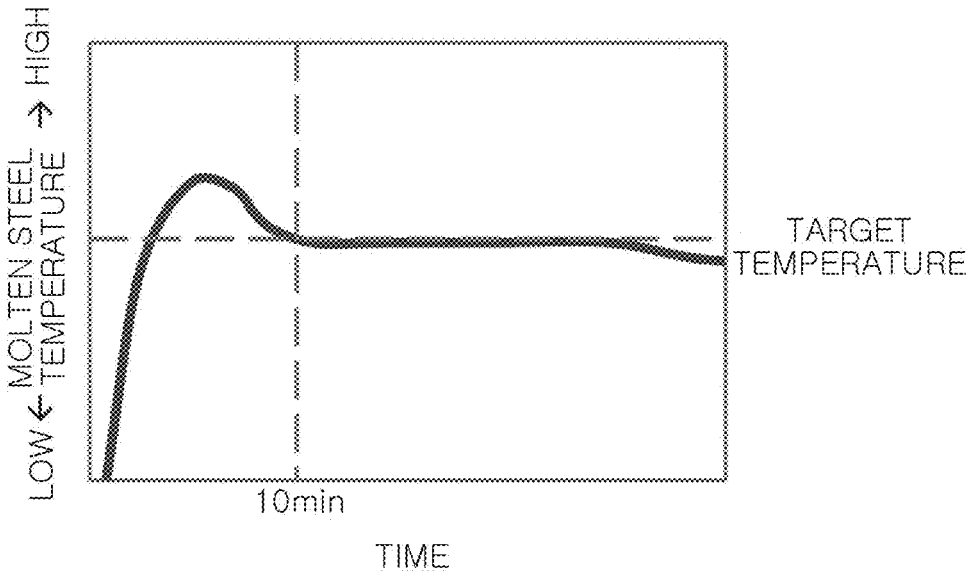
FIG. 7 PRIOR ART
FIG. 7 is a graph illustrating a molten steel temperature with respect to a casting time in a twin roll strip casting process of the related art.
Figure 8:
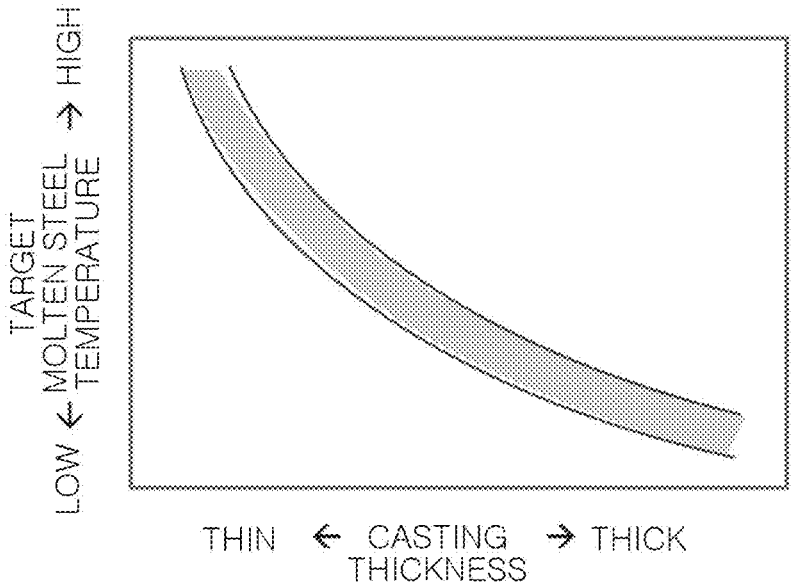
FIG. 8 PRIOR ART
FIG. 8 is a graph illustrating a target molten steel temperature with respect to a casting thickness in a twin roll strip casting process of the related art.

As casting proceeds, the casting thickness is increased after 10 minutes from the start of casting as shown in FIG. 7, and before that time, the temperature of molten steel contained in a molten steel pool reaches a target temperature. As shown in FIG. 8, the target temperature of molten steel may be varied according to the kind of steel and the thickness of a strip to be formed. The casting thickness is increased after 10 minutes due to the following reasons. If the temperature of molten steel contained in the molten steel pool is higher than the target temperature, a large temperature differential exists between the molten steel and the solidified shells, and thus the rate of solidification may be varied to increase the separation of edge regions and edge bulging. Therefore, after comparing the temperature of molten steel with the target temperature determined according to the kind of steel and the thickness of a strip to be formed and checking the state of bulging, the casting thickness is increased within a range not casing bulging.

In this above-mentioned method, since the casting thickness is increased while producing a strip having the same thickness, the reduction ratio of rolling is relatively increased, and thus the strip may have a uniform cast structure. In addition, since the casting thickness of a strip is increased, the length of a strip making frictional contact with the edge dams is practically reduced to decrease the amount of wear, and thus the amount of casting may be increased by at least 25%.

Figure 9:
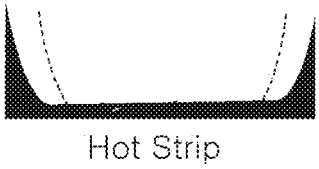
FIG. 9 is an image of a hot strip disposed under a casting roll when the strip is produced according to an exemplary embodiment of the present disclosure.
Figure 10:
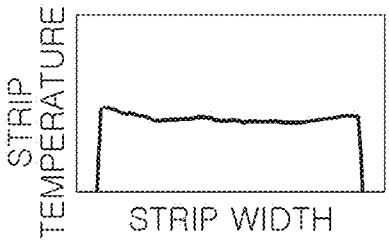
FIG. 10 is a graph illustrating the temperature of the strip with respect to the width of the strip when the strip is produced according to the exemplary embodiment of the present disclosure.
Figure 11:
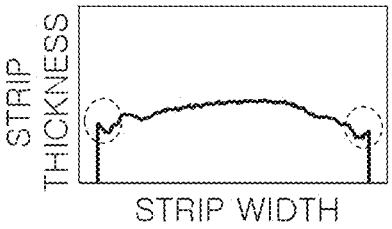
FIG. 11 is a graph illustrating the thickness of the strip with respect to the width of the strip when the strip is produced according to the exemplary embodiment of the present disclosure.

FIGS. 9 to 11 are an image of a hot strip disposed under a casting roll, a graph illustrating the temperature of the strip with respect to the width of the strip, and a graph illustrating the thickness of the strip with respect to the width of the strip when the strip is produced according to the twin roll strip casting method of the exemplary embodiment of the present disclosure.

In detail, FIG. 9 illustrates the surface state of a hot strip disposed under a casting roll when edge bulging does not occurs. FIG. 10 illustrates the temperature of the strip with respect to the width of the strip, and FIG. 11 illustrates the thickness of the strip with respect to the width of the strip. The temperature and thickness of edge regions of the strip are decreased as compared with the edge regions of the strip illustrated in FIGS. 2 to 4.

As described above, in the strip casting method using a twin roll strip casting process according to the exemplary embodiment of the present disclosure, the casting thickness is varied during the casting process to reduce edge bulging that may occur in an early stage of the casting process. Thus, a strip having a high degree of edge quality may be produced, and a casting amount may also be increased.

As set forth above, according to the exemplary embodiments of the present disclosure, when a hot-rolled coil is produced by directly casting molten steel in a strip casting process, initial edge bulging may be reduced to improve the edge quality of a product.

In addition, according to the strip casting method of the present disclosure, strips having a high degree of quality may be produced with an improved yield, and a casting amount may also be increased.

While exemplary embodiments have been shown and described above, it will be apparent to those skilled in the art that modifications and variations could be made without departing from the scope of the present invention as defined by the appended claims.

What is claimed is:

1. A strip casting method using a twin roll strip casting process in which molten steel is supplied through an injection nozzle to a region between twin rolls rotating in opposite directions to produce a strip having a predetermined thickness and a high degree of edge quality, the twin roll strip casting method comprising:

performing the casting process by setting a casting thickness to have a minimal value during an early stage of the casting process in which edge bulging occurs; and performing the casting process by increasing the casting thickness to a maximum value after the molten steel reaches a pre-set target temperature as the casting process proceeds, wherein the minimal value of the casting thickness is set to be within a range of 130% to 150% of a final product thickness to obtain a reduction ratio of 25% or above.

2. The strip casting method of claim 1, wherein the maximum value of the casting thickness is set to be within a range of 150% to 200% of a final product thickness.

3. The strip casting method of claim 1, wherein the casting thickness is increased to reduce an amount of wear of edge dams and consequently increase a casting amount by at least 25%.

* * * * *